US011312147B2

(12) United States Patent
Sawadaishi et al.

(10) Patent No.: US 11,312,147 B2
(45) Date of Patent: Apr. 26, 2022

(54) LIQUID STORAGE CONTAINER AND LIQUID EJECTING APPARATUS

(71) Applicant: SEIKO EPSON CORPORATION, Tokyo (JP)

(72) Inventors: Makoto Sawadaishi, Shiojiri (JP); Naomi Kimura, Okaya (JP); Yusuke Hirasawa, Matsumoto (JP); Shoma Kudo, Shiojiri (JP)

(73) Assignee: SEIKO EPSON CORPORATION, Tokyo (JP)

( * ) Notice: Subject to any disclaimer, the term of this patent is extended or adjusted under 35 U.S.C. 154(b) by 12 days.

(21) Appl. No.: 17/066,801

(22) Filed: Oct. 9, 2020

(65) Prior Publication Data

US 2021/0107290 A1 Apr. 15, 2021

(30) Foreign Application Priority Data

Oct. 10, 2019 (JP) ..... JP2019-186602

(51) Int. Cl.
*B41J 2/175* (2006.01)

(52) U.S. Cl.
CPC ..... *B41J 2/17553* (2013.01); *B41J 2/17566* (2013.01)

(58) Field of Classification Search
CPC .... B41J 2/175; B41J 2/17506; B41J 2/17509; B41J 2/17513; B41J 2/17553; B41J 2/17566; B41J 29/02; B41J 29/13; B41J 2002/17573
See application file for complete search history.

(56) References Cited

U.S. PATENT DOCUMENTS 5,903,294 A * 5/1999 Abe ..... B41J 2/17556 347/87
6,616,255 B2 * 9/2003 Murakami ..... B41J 2/17509 347/7
7,841,711 B2 * 11/2010 Matsumoto ..... B41J 2/17543 347/86
8,079,689 B2 * 12/2011 Hattori ..... B41J 2/17523 347/86

(Continued)

FOREIGN PATENT DOCUMENTS

JP 2016-190354 A 11/2016
JP 2018-153947 A 10/2018
JP 2019-018368 A 2/2019

*Primary Examiner* — Anh T Vo
(74) *Attorney, Agent, or Firm* — Oliff PLC

(57) ABSTRACT

A liquid storage container which includes a liquid storage chamber that includes a bottom surface, an upper surface facing the bottom surface, a first side surface orthogonal to the bottom surface and the upper surface, and a second side surface orthogonal to the bottom surface and the upper surface and facing the first side surface, and, in which the first side surface is provided with a visual recognition surface configured such that the liquid stored in the liquid storage chamber is visually recognized, the bottom surface is provided with a prism for detecting the liquid, and the liquid storage chamber is provided with a wall surface closer to the upper surface than the prism and closer to the bottom surface than an end of the visual recognition surface, which is on a side of the upper surface, in a first direction from the upper surface toward the bottom surface.

9 Claims, 9 Drawing Sheets

(56) References Cited

U.S. PATENT DOCUMENTS

| | | | | |
|---|---|---|---|---|
| 8,465,137 | B2 * | 6/2013 | Fujikawa | B41J 2/1752 347/86 |
| 2018/0111377 | A1 | 4/2018 | Kimura et al. | |
| 2019/0016147 | A1 | 1/2019 | Naito et al. | |

* cited by examiner

LIQUID STORAGE CONTAINER AND LIQUID EJECTING APPARATUS

The present application is based on, and claims priority from JP Application Serial Number 2019-186602, filed Oct. 10, 2019, the disclosure of which is hereby incorporated by reference herein in its entirety.

BACKGROUND

1. Technical Field

The present disclosure relates to a liquid storage container and a liquid ejecting apparatus.

2. Related Art

A liquid ejecting apparatus that records an image, a character, or the like on a medium by ejecting liquid such as ink from a liquid ejecting head onto the medium is known in the related art. Such a liquid ejecting apparatus includes a liquid storage container in which liquid to be supplied to the head is stored. For example, JP-A-2016-190354 discloses a tank unit as a liquid storage container that includes a prism serving as an optical element for detecting a remaining amount of ink in an ink storage chamber, in which the ink is stored, by using an optical unit.

However, the liquid storage container described in JP-A-2016-190354 is configured so as to allow visual recognition of an amount of liquid, and therefore external light entering from a visual recognition surface through which the liquid is visually recognized may reach the optical element for detecting the liquid. As a result, there is a possibility that the liquid in the liquid storage container is erroneously detected.

SUMMARY

A liquid storage container stores liquid to be supplied to a liquid ejecting head that ejects the liquid onto a medium. The liquid storage container includes a liquid storage chamber that includes a bottom surface, an upper surface facing the bottom surface, a first side surface orthogonal to the bottom surface and the upper surface, and a second side surface orthogonal to the bottom surface and the upper surface and facing the first side surface, and that is configured to store the liquid, in which the first side surface is provided with a visual recognition surface configured such that the liquid stored in the liquid storage chamber is visually recognized, the bottom surface is provided with an optical element for detecting the liquid, and the liquid storage chamber is provided with a wall surface closer to the upper surface than the optical element and closer to the bottom surface than an end of the visual recognition surface, which is on a side of the upper surface, in a first direction from the upper surface toward the bottom surface.

In the liquid storage container, the upper surface may be provided with a liquid pouring port through which the liquid is poured into the liquid storage chamber, and the wall surface may be overlapped with the liquid pouring port and the optical element in plan view in the first direction.

In the liquid storage container, the wall surface may be inclined with respect to the bottom surface.

In the liquid storage container, the wall surface may extend in a direction from the first side surface to the second side surface and may be inclined from the side of the upper surface toward a side of the bottom surface.

In the liquid storage container, the bottom surface may be provided with a filter portion that filters the liquid to be supplied from the liquid storage chamber to the liquid ejecting head, and the filter portion may be positioned closer to the second side surface than the optical element in a second direction from the first side surface to the second side surface.

In the liquid storage container, the wall surface may include a light shielding material.

In the liquid storage container, irregularity may be formed on the wall surface.

In the liquid storage container, the wall surface may have a black color.

A liquid ejecting apparatus includes: the liquid storage container according to any one of liquid storage containers; a carriage on which a liquid ejecting head ejecting liquid onto a medium and the liquid storage container are mounted and which is configured to reciprocate in a third direction that crosses the first direction and is along the second side surface; and a sensor that detects, at the bottom surface, the liquid stored in the liquid storage chamber, in which when the carriage reciprocates in the third direction, the sensor is overlapped with the optical element in plan view in the first direction.

A liquid ejecting apparatus includes: the liquid storage container according to any one of the liquid storage containers; a carriage on which a liquid ejecting head ejecting liquid onto a medium is mounted; a liquid supply tube that supplies the liquid from the liquid storage container to the liquid ejecting head; and a sensor that detects, at the bottom surface, the liquid stored in the liquid storage chamber, in which the sensor is overlapped with the optical element in plan view in the first direction.

DESCRIPTION OF EXEMPLARY EMBODIMENTS

Figure 1:
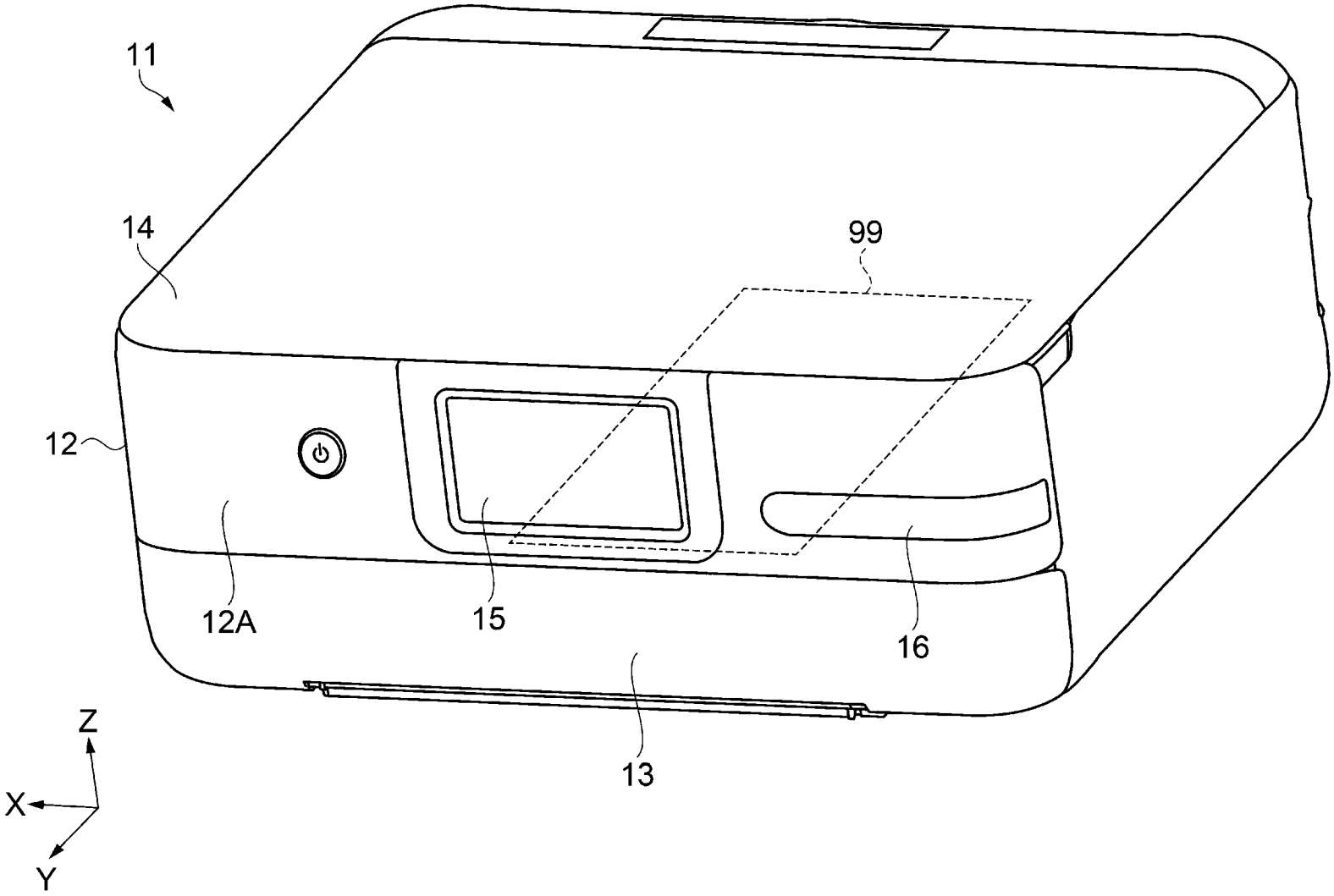
FIG. 1 is a perspective view illustrating a configuration of a liquid ejecting apparatus according to Embodiment 1.

Embodiments will be described below with reference to the drawings. Note that, coordinates in the drawings indicates that both directions along a Z axis are defined as up and down directions in which the direction indicated by an arrow is an "upward" direction, both directions along a Y axis are defined as front and rear directions in which the direction indicated by an arrow is a "forward" direction, and both directions along an X axis are defined as left and right directions in which the direction indicated by an arrow is a "leftward" direction. Further, a tip end side of the arrow indicating each axis is defined as a "positive side" and a base end side is defined as a "negative side".

1. Embodiment 1

Figure 2:
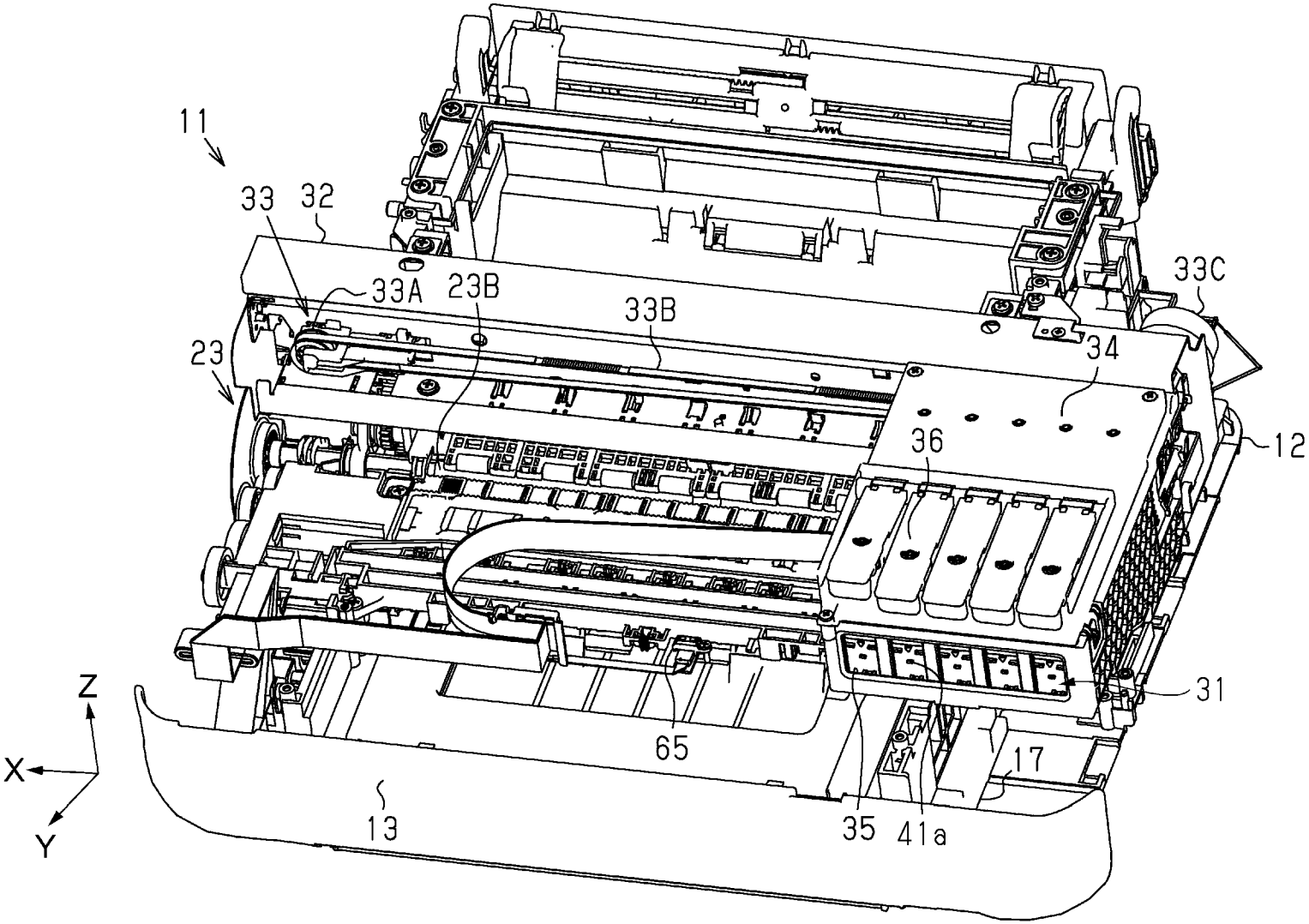
FIG. 2 is a perspective view illustrating an inner configuration of the liquid ejecting apparatus.
Figure 3:
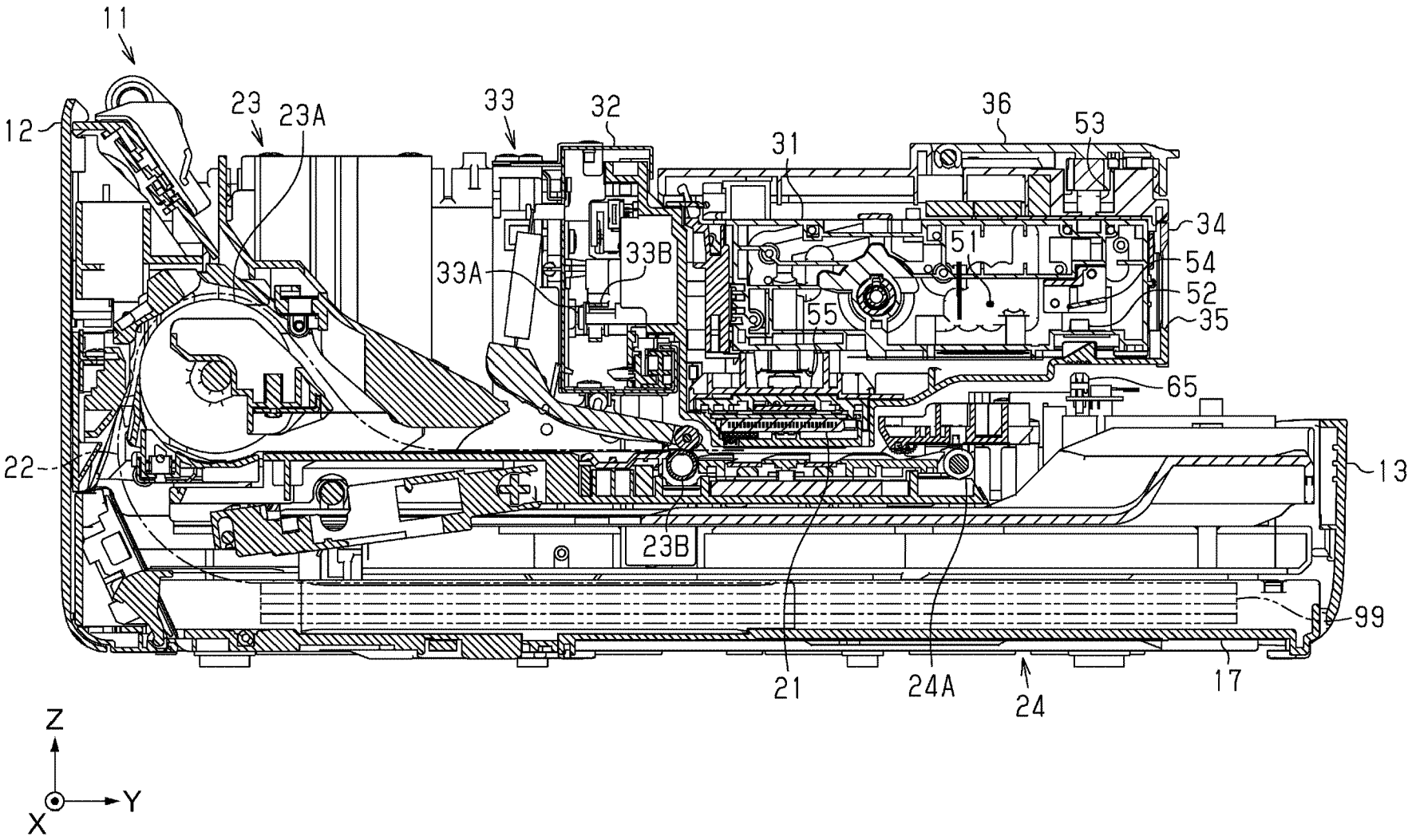
FIG. 3 is a sectional view of the liquid ejecting apparatus.

FIG. 1 is a perspective view illustrating a configuration of a liquid ejecting apparatus according to Embodiment 1. FIG. 2 is a perspective view illustrating an inner configuration of the liquid ejecting apparatus. FIG. 3 is a sectional view of the liquid ejecting apparatus. First, a configuration of a liquid ejecting apparatus 11 will be described. The liquid ejecting apparatus 11 is an ink jet printer that prints an image of a character, a picture, or the like by ejecting ink, which is an example of liquid, onto a medium 99 such as a sheet.

As illustrated in FIG. 1, the liquid ejecting apparatus 11 includes a housing 12, a display portion 15, and a visual recognition portion 16.

The housing 12 includes a first cover 13 and a second cover 14. The first cover 13 and the second cover 14 are configured to open/close with respect to the housing 12. In FIG. 1, the first cover 13 and the second cover 14 are closed. In a closed state, the first cover 13 of the present embodiment is provided so as to be continuous with a front surface 12A of the housing 12. When the first cover 13 is opened, an inside of the housing 12 is exposed. When the first cover 13 is opened, the liquid ejecting apparatus 11 is able to discharge the medium 99 subjected to printing in the housing 12. The second cover 14 of the present embodiment is provided on a top of the housing 12. When the second cover 14 is opened, the inside of the housing 12 is exposed. For example, by opening the second cover 14, a user is able to perform maintenance of components inside the housing 12.

The display portion 15 is provided, for example, on the front surface 12A of the housing 12. The display portion 15 displays information about the liquid ejecting apparatus 11. The display portion 15 is, for example, a liquid crystal screen. The display portion 15 may be a touch panel.

The visual recognition portion 16 is provided, for example, on the front surface 12A of the housing 12. The visual recognition portion 16 is constituted by a transparent or semi-transparent material such as glass or plastic. The visual recognition portion 16 may be an opening provided in the front surface 12A. The user is able to visually recognize the inside of the housing 12 through the visual recognition portion 16.

As illustrated in FIG. 2, the liquid ejecting apparatus 11 includes a cassette 17. The cassette 17 is configured so as to be attachable to and detachable from the housing 12. In FIG. 2, the cassette 17 is attached to the housing 12. The cassette 17 is configured to store the medium 99 therein. Attachment and detachment of the cassette 17 is able to be performed from the front of the housing 12.

The liquid ejecting apparatus 11 performs printing on the medium 99 supplied from the cassette 17. The liquid ejecting apparatus 11 may be configured to allow the medium 99 to be supplied not only from the cassette 17 but also from a rear surface or an upper surface of the housing 12. In the present embodiment, the first cover 13 is attached to the cassette 17.

As illustrated in FIG. 3, the liquid ejecting apparatus 11 includes a liquid ejecting head 21, a transport path 22, a transport portion 23, and a discharge portion 24.

The liquid ejecting head 21 ejects liquid onto the medium 99. The liquid ejecting head 21 performs printing on the medium 99 by ejecting the liquid onto the medium 99.

The transport path 22 is a path in which the medium 99 is transported along the Y axis. The transport path 22 extends from the cassette 17 to the liquid ejecting head 21. The transport path 22 extends so as to turn back on the way from the cassette 17 to the liquid ejecting head 21. Therefore, a posture of the medium 99 is inverted upside down between the medium 99 stored in the cassette 17 and the medium 99 facing the liquid ejecting head 21.

The transport portion 23 transports the medium 99 along the transport path 22. The transport portion 23 has a first transport roller 23A and a second transport roller 23B. The first transport roller 23A and the second transport roller 23B are positioned along the transport path 22. The first transport roller 23A is a roller that transports the medium 99 while inverting the medium 99. In the transport path 22, the first transport roller 23A is positioned upstream the second transport roller 23B.

The discharge portion 24 has a discharge roller 24A and discharges the printed medium 99 outside the housing 12.

As illustrated in FIGS. 2 and 3, the liquid ejecting apparatus 11 includes a liquid storage container 31, a guide portion 32, a moving mechanism 33, and a carriage 34.

In the liquid storage container 31, the liquid to be supplied to the liquid ejecting head 21 is stored. Therefore, the liquid ejecting head 21 ejects the liquid stored in the liquid storage container 31. In the present embodiment, a plurality of liquid storage containers 31 are provided. In the plurality of liquid storage containers 31, for example, different types of liquid are stored. A detailed configuration of each of the liquid storage containers 31 will be described later.

The guide portion 32 guides movement of the carriage 34. The guide portion 32 extends along the X axis. The guide portion 32 is a frame that supports the carriage 34.

The moving mechanism 33 is a mechanism that reciprocates the carriage 34 in both the directions along the X axis. The moving mechanism 33 of the present embodiment has paired pulleys 33A, a belt 33B, and a motor 33C.

The paired pulleys 33A are provided at opposite ends of the guide portion 32. The belt 33B is wound around the paired pulleys 33A. A part of the belt 33B is attached to the carriage 34. The motor 33C is coupled to one of the pulleys 33A. When the motor 33C is driven, the belt 33B circulates. In this manner, the moving mechanism 33 moves the carriage 34.

The carriage 34 is configured so as to perform scanning for the medium 99. The carriage 34 reciprocates in a third direction that crosses a first direction from an upper surface 44 of the liquid storage container 31 described later, which is mounted on the carriage 34, toward a bottom surface 42 thereof, and that is along a first side surface 41. Specifically, the carriage 34 is configured so as to move in one of both the directions along the X axis and the other.

The carriage 34 normally waits at a home position. The home position is a position where the carriage 34 waits when no printing is performed. The position of the carriage 34 when being positioned in one end of the guide portion 32, which is on the negative side along the X axis, is the home position, and the position of the carriage 34 when being positioned in the other end of the guide portion 32, which is on the positive side along the X axis, is an opposite home position.

The liquid ejecting head 21 and the liquid storage container 31 are mounted on the carriage 34. The plurality of liquid storage containers 31 are mounted on the carriage 34.

The plurality of liquid storage containers 31 are arranged side by side along the X axis in the carriage 34. In the present embodiment, five liquid storage containers 31 are mounted on the carriage 34.

The carriage 34 has an exposure opening 35 from which the liquid storage container 31 is exposed. In the present embodiment, the plurality of liquid storage containers 31 are exposed from the exposure opening 35. A surface of the liquid storage container 31 exposed from the exposure opening 35 is a visual recognition surface 41*a* through which the liquid stored in the liquid storage container 31 is able to be visually recognized. The user is able to visually recognize the visual recognition surface 41*a* of the liquid storage container 31 through the visual recognition portion 16 and the exposure opening 35 from the outside of the housing 12. Therefore, the visual recognition portion 16 is provided at a position corresponding to the carriage 34, which is positioned at the home position, in the front surface 12A.

The carriage 34 has a cap 36. The cap 36 is configured to open/close. The cap 36 illustrated in FIG. 3 is closed. When the cap 36 is opened, the liquid is able to be poured into the liquid storage container 31. In the present embodiment, caps 36 are provided to be equal in number to the liquid storage containers 31.

Figure 4:
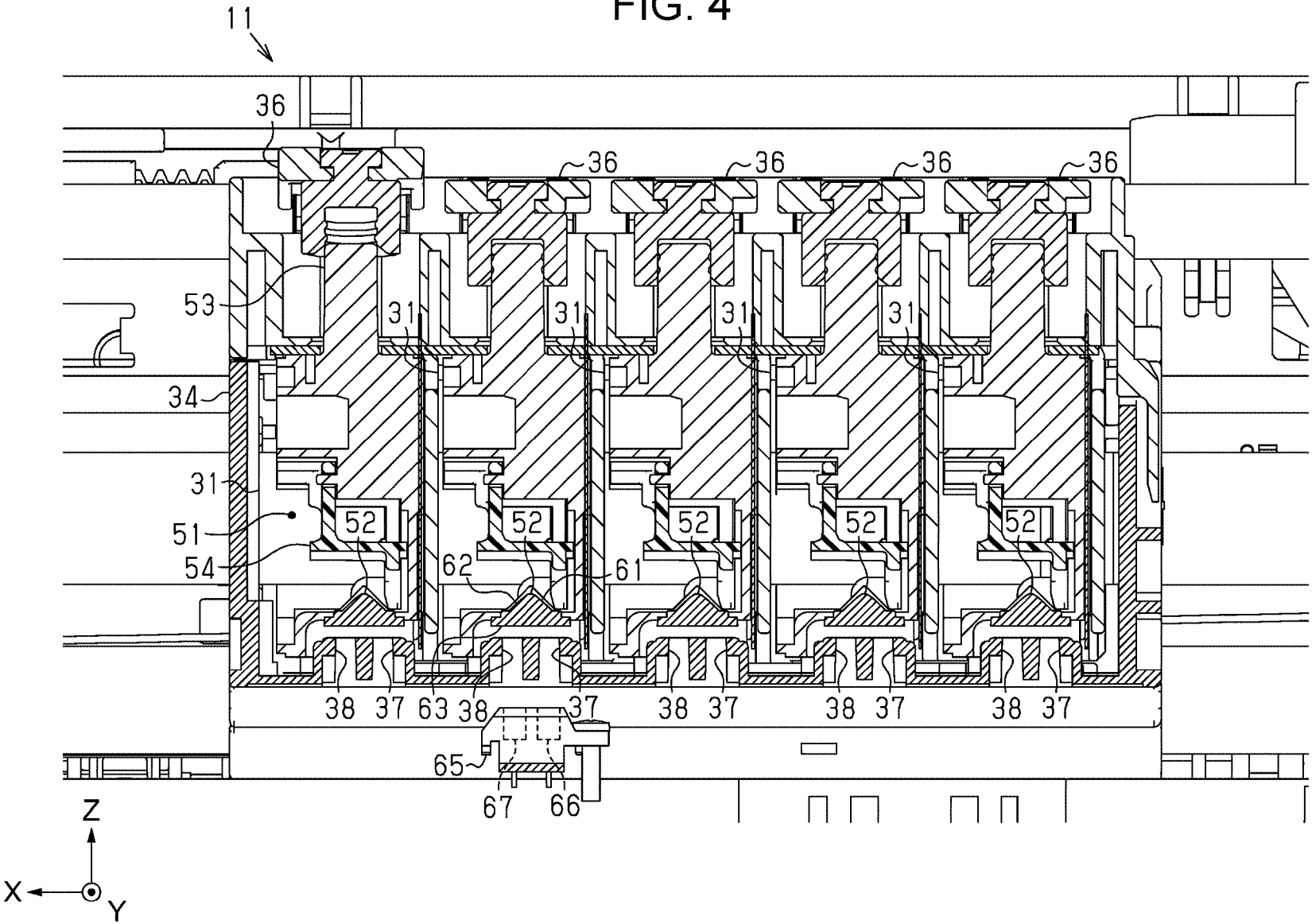
FIG. 4 is a sectional view of a carriage and a liquid storage container.

As illustrated in FIG. 4, the carriage 34 has a first opening 37 and a second opening 38 that are opened at a bottom of the carriage 34. The first opening 37 and the second opening 38 are provided to be equal in number to the liquid storage containers 31.

The liquid ejecting apparatus 11 of the present embodiment prints an image, a character, or the like on the medium 99 by alternately repeating sub-scanning of causing the medium 99 to be transported along the Y axis and main scanning of causing the liquid ejecting head 21, which is mounted on the carriage 34, to ejected liquid while causing the liquid ejecting head 21 to move along the X axis.

Figure 5:
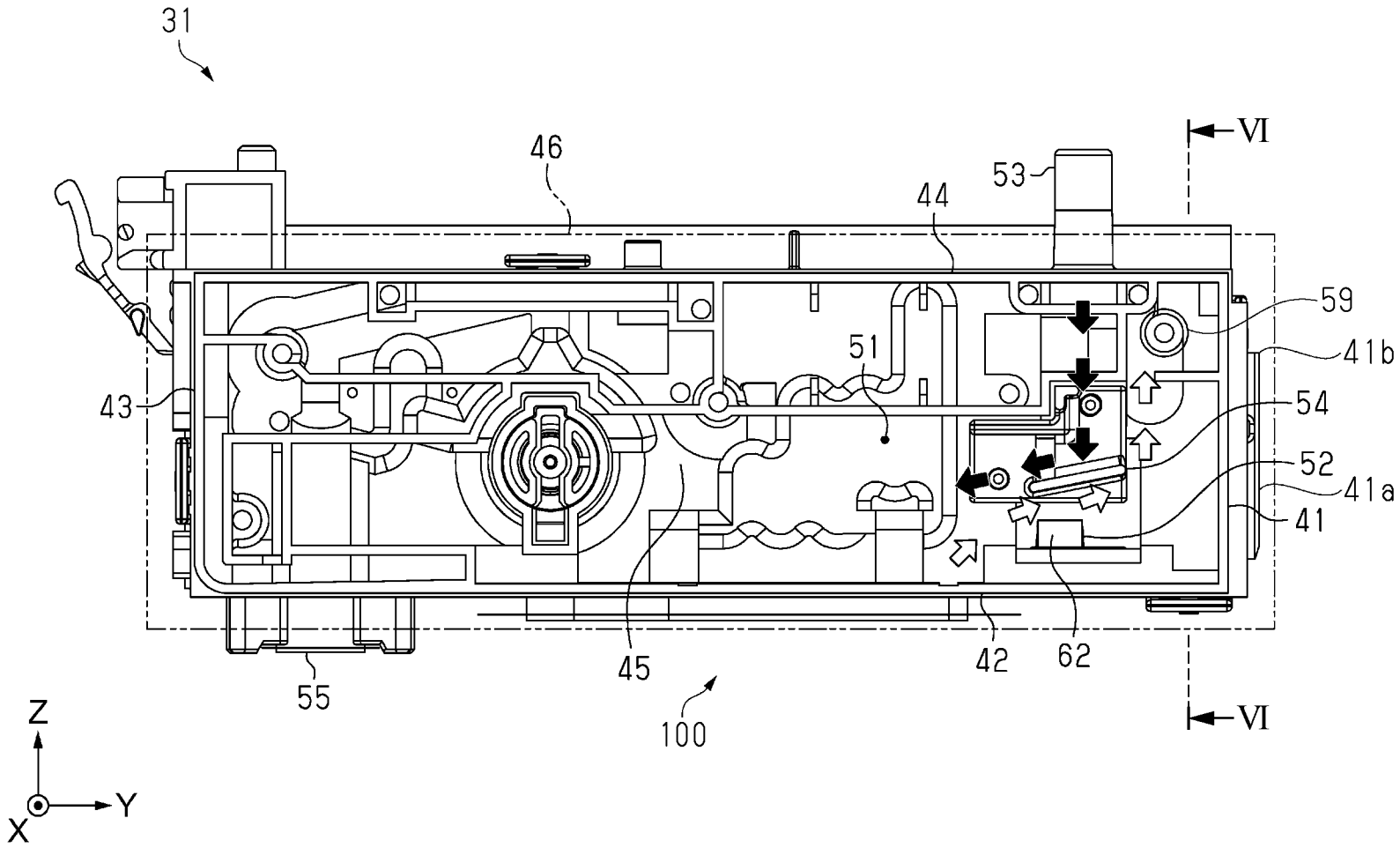
FIG. 5 is a side view of the liquid storage container.
Figure 6:
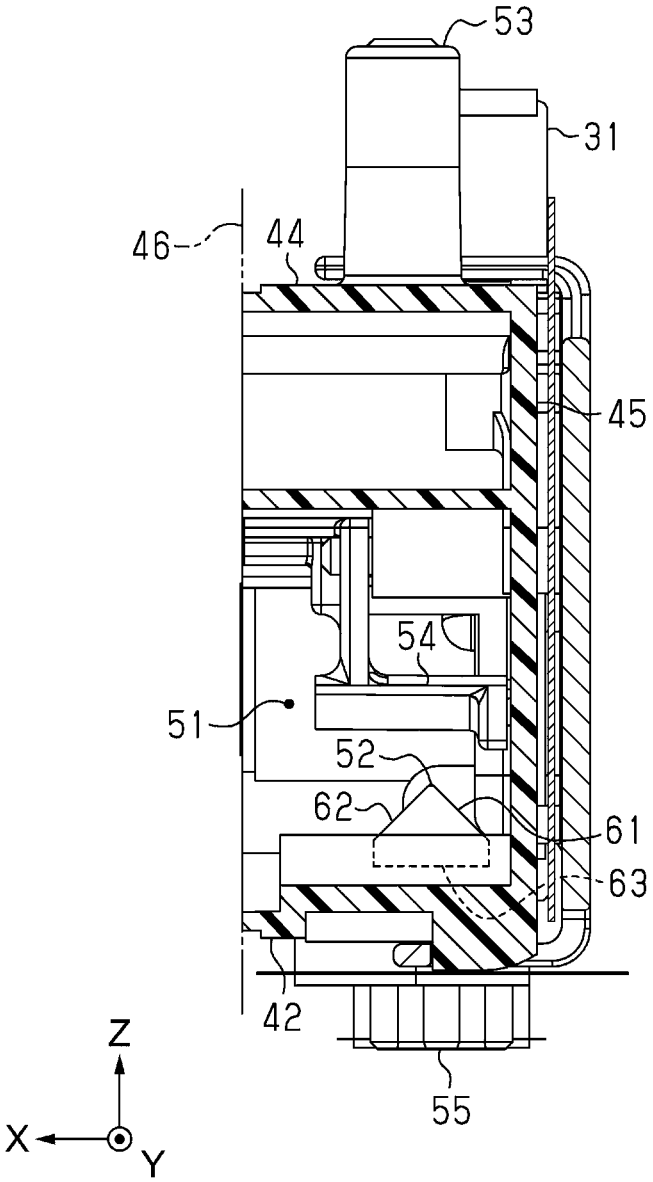
FIG. 6 is a sectional view taken along a line VI-VI in FIG. 5.
Figure 7:
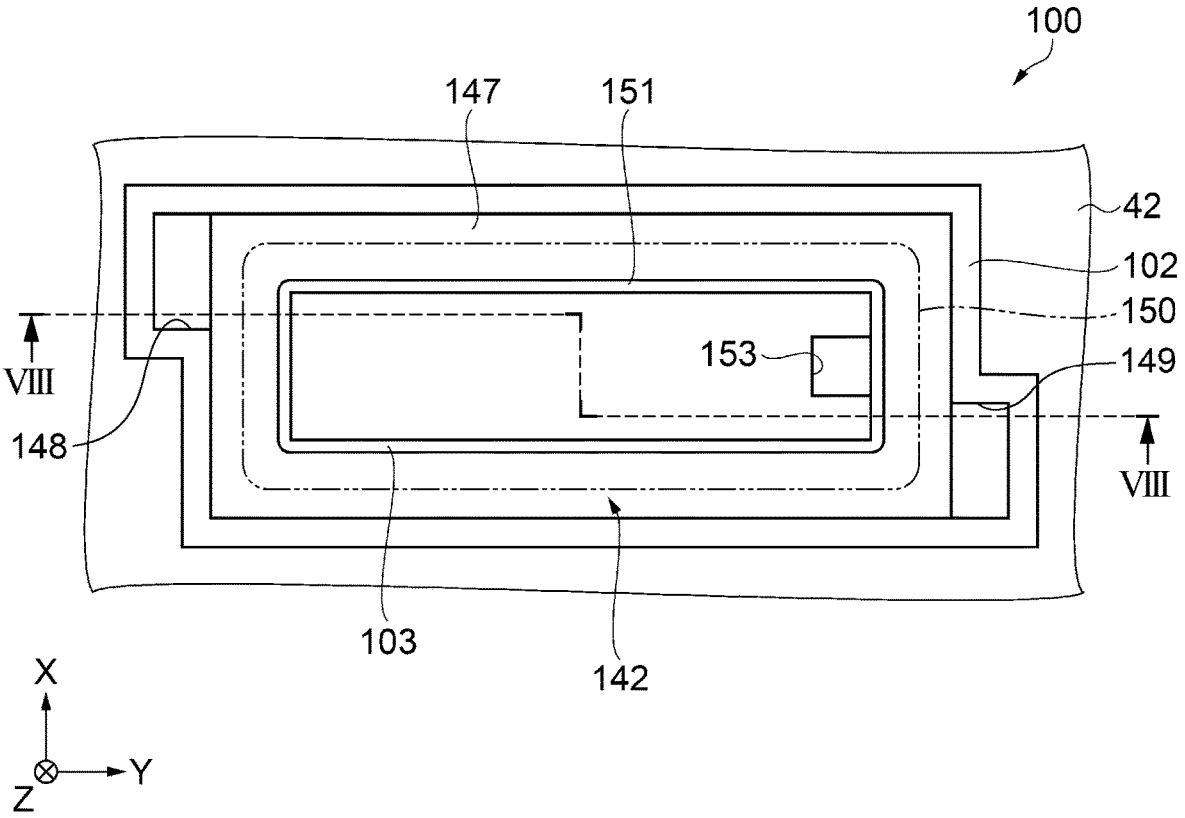
FIG. 7 is a plan view illustrating a configuration of a filter portion.
Figure 8:
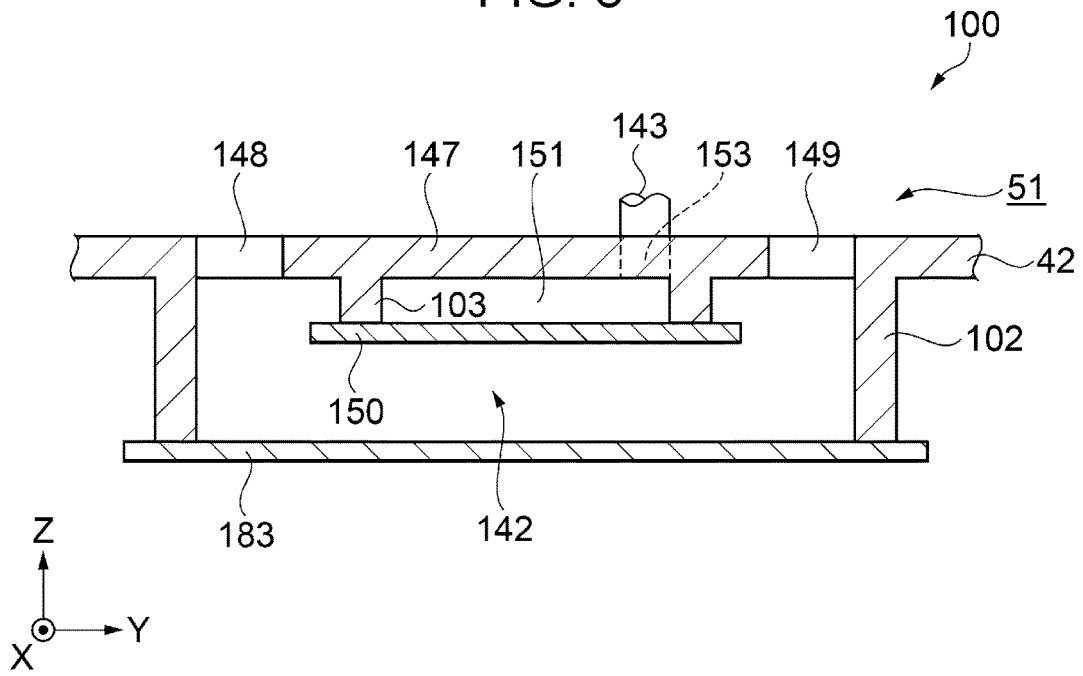
FIG. 8 is a sectional view taken along a line VIII-VIII in FIG. 7.

FIG. 4 is a sectional view of the carriage and the liquid storage container. FIG. 5 is a side view of the liquid storage container. FIG. 6 is a sectional view taken along a line VI-VI in FIG. 5. FIG. 7 is an enlarged plan view of a filter portion. FIG. 8 is a sectional view taken along a line VIII-VIII in FIG. 7. Note that, FIG. 7 is the plan view seen from the negative side of the Z axis, and, for convenience of description, illustration of a film 183 illustrated in FIG. 8 is omitted so that a filter 150 is seen through. Next, a configuration of the liquid storage container 31 will be described.

As illustrated in FIG. 5, the liquid storage container 31 includes a liquid storage chamber 51, a liquid pouring port 53, a coupling portion 55, and a filter portion 100, and is constituted by a transparent or semi-transparent material.

The liquid storage chamber 51 has the first side surface 41, the bottom surface 42, a second side surface 43, the upper surface 44, a third side surface 45, and a fourth side surface 46 and is configured to store the liquid therein. In a state of being mounted on the carriage 34, the liquid storage chamber 51 has a rectangular parallelepiped shape that is elongated in the Y axis. The bottom surface 42 is a bottom wall on the negative side of the Z axis. The upper surface 44 is an upper wall that faces the bottom surface 42 and is on the positive side of the Z axis. The first side surface 41 is a front wall orthogonal to the bottom surface 42 and the upper surface 44 and is on the positive side of the Y axis. The second side surface 43 is a rear wall orthogonal to the bottom surface 42 and the upper surface 44, faces the first side surface 41, and is on the negative side of the Y axis. The third side surface 45 is a side wall that is surrounded by the first side surface 41, the bottom surface 42, the second side surface 43, and the upper surface 44 and is on the negative side of the X axis. The fourth side surface 46 is a film that faces the third side surface 45 and is on the positive side of the X axis. The film forming the fourth side surface 46 is welded by end surfaces of the first side surface 41, the bottom surface 42, the second side surface 43, and the upper surface 44. The first side surface 41, the bottom surface 42, the second side surface 43, the upper surface 44, and the third side surface 45 are integrally formed with polypropylene resin or the like.

In the first side surface 41, the visual recognition surface 41*a* through which the liquid stored in the liquid storage chamber 51 is able to be visually recognized is provided at a position corresponding to the exposure opening 35 provided in the carriage 34.

Note that, in the following description, it is also defined that a direction from the upper surface 44 toward the bottom surface 42 is a first direction, a direction from the first side surface 41 toward the second side surface 43 is a second direction, and a direction that crosses the first direction and extends along the first side surface 41, that is, a direction from the third side surface 45 toward the fourth side surface 46 is a third direction.

As illustrated in FIGS. 5 and 6, the liquid pouring port 53 is a port, through which the liquid is poured from the outside into the liquid storage chamber 51, and provided on the positive side of the Y axis on the upper surface 44. The liquid pouring port 53 is a tube one end of which extends upward from the upper surface 44 and the other end of which communicates with the liquid storage chamber 51. The liquid storage container 31 allows the liquid to be poured into the liquid storage chamber 51 through the liquid pouring port 53. When the cap 36 provided in the carriage 34 is opened, the liquid pouring port 53 is exposed. When the cap 36 is closed, the liquid pouring port 53 is covered by the cap 36. The closure with the cap 36 suppresses possibility of evaporation of the liquid in the liquid storage chamber 51 through the liquid pouring port 53.

The liquid storage container 31 includes an atmosphere open port 59 through which gas in the liquid storage chamber 51 is discharged to the outside. The atmosphere open port 59 is provided in an upper portion of the third side surface 45 between the first side surface 41 and the liquid pouring port 53 in side view from the X axis.

The coupling portion 55 allows the liquid in the liquid storage chamber 51 to be supplied to the liquid ejecting head 21. The coupling portion 55 is provided on the bottom surface 42 close to the second side surface 43 in the second direction. The coupling portion 55 has one end extended downward from the bottom surface 42 and the other end coupled to a liquid flow path 143 described below. The liquid flow path 143 is a tube that communicates with the liquid storage chamber 51 through the filter portion 100. When the liquid storage container 31 is mounted on the carriage 34, the one end of the coupling portion 55 is coupled to the liquid ejecting head 21. The coupling portion 55 of the present embodiment is provided at a position closer to the second side surface 43 than to the filter portion 100.

As illustrated in FIG. 5, the filter portion 100 is positioned closer to the second side surface than to a prism 52 described later in the second direction. The filter portion 100 of the present embodiment is positioned between the prism 52 and the coupling portion 55 and formed at a position recessed one level from the bottom surface 42. The filter portion 100 filters the liquid to be supplied from the liquid storage chamber 51 to the liquid ejecting head 21 through the coupling portion 55. The filter portion 100 has a filter chamber 142, a first communication path 148, a second communication path 149, the filter 150, and an outlet path 151.

As illustrated in FIGS. 7 and 8, a part of the bottom surface 42 functions as a partition wall 147 that defines the liquid storage chamber 51 and the filter chamber 142. The partition wall 147 has a rectangular shape that is elongated in the Y axis in plan view. The first communication path 148 is an opening provided so as to extend to the negative side of the Y axis on the positive side of the X axis at the partition wall 147 in plan view. The second communication path 149 is an opening provided so as to extend to the positive side of the Y axis on the negative side of the X axis at the partition wall 147 in plan view. The filter chamber 142 is constituted by the partition wall 147, a first peripheral wall portion 102 that surrounds the partition wall 147 and the first and second communication paths 148 and 149 and has a frame shape extending to the negative side of the Z axis, and the film 183 that covers an end surface of the first peripheral wall portion 102, which is on the negative side of the Z axis. The filter chamber 142 and the liquid storage chamber 51 communicate with each other through the first communication path 148 and the second communication path 149.

In the filter chamber 142, the outlet path 151 having a rectangular shape that is elongated in the Y axis in plan view is provided. The outlet path 151 is constituted by the partition wall 147, a second peripheral wall portion 103 that has a frame shape extending from the partition wall 147 to the negative side of the Z axis, and the filter 150 that covers an end surface of the second peripheral wall portion 103, which is on the negative side of the Z axis. The filter 150 also serves as an inlet through which the liquid flows into the outlet path 151. The filter 150 is a mesh filter made of stainless steel, and filters a foreign matter mixed in the liquid, air blended into the liquid, or the like. The second peripheral wall portion 103 is separated from an inner wall of the first peripheral wall portion 102 in plan view. The filter 150 is separated from the film 183 in side view. The foreign matter filtered by the filter 150 is dropped through the filter 150 by gravity. The air filtered by the filter 150 results in an air bubble, the air bubble rises to the liquid storage chamber 51 through the first and second communication paths 148 and 149 due to buoyancy thereof and results in gas again, and the gas is released into the atmosphere through the atmosphere open port 59.

The partition wall 147 constituting the outlet path 151 is provided with an outlet 153 through which the liquid flows out from the outlet path 151. The outlet 153 is coupled to the liquid flow path 143 that communicates with the liquid ejecting head 21 through the coupling portion 55. Thereby, the liquid that flows into the filter chamber 142 from the liquid storage chamber 51 through the first and second communication paths 148 and 149 and is filtered by the filter 150 is supplied to the liquid ejecting head 21.

Next, the prism 52 as an optical element provided inside the liquid storage chamber 51, and a wall surface 54 provided above the prism 52 will be described.

As illustrated in FIGS. 4 to 6, the prism 52 for detecting the liquid accumulated in the liquid storage chamber 51 is provided on the bottom surface 42 constituting the liquid storage chamber 51.

The prism 52 is a triangular prism. The prism 52 has a first surface 61, a second surface 62, and a third surface 63 that form a triangle. The prism 52 is installed such that the first surface 61 faces the third side surface 45, the second surface 62 faces the fourth side surface 46, and the third surface 63 is parallel to the bottom surface 42. That is, the first surface 61 and the second surface 62 extend into the liquid storage chamber 51. Therefore, when sufficient liquid is stored in the liquid storage chamber 51, the first surface 61 and the second surface 62 contact the liquid. Moreover, the third surface 63 is provided so as to be exposed from the bottom surface 42.

The carriage 34 on which the liquid storage container 31 is mounted is provided with the first opening 37 and the second opening 38 at positions corresponding to the third surface 63 of the prism 52. Thereby, the third surface 63 of the prism 52 is exposed from the outside of the carriage 34. In plan view in the first direction, the first opening 37 is overlapped with the first surface 61 with the third surface 63 in between and the second opening 38 is overlapped with the second surface 62 with the third surface 63 in between. Moreover, the prism 52 is provided at a position where the prism 52 is overlapped with the liquid pouring port 53 in plan view in the first direction.

As illustrated in FIG. 2, the liquid ejecting apparatus 11 includes a sensor 65 that detects, at the bottom surface 42, the liquid stored in the liquid storage container 31. In the present embodiment, the sensor 65 is positioned below the carriage 34. The sensor 65 is positioned in a region between the home position and the opposite home position. When the carriage 34 reciprocates in the third direction, that is, in one direction and the other direction along the X axis, the sensor 65 is overlapped with the prism 52, which is provided in the liquid storage container 31 mounted on the carriage 34 that passes right above the sensor 65, in plan view in the first direction.

Figure 9:
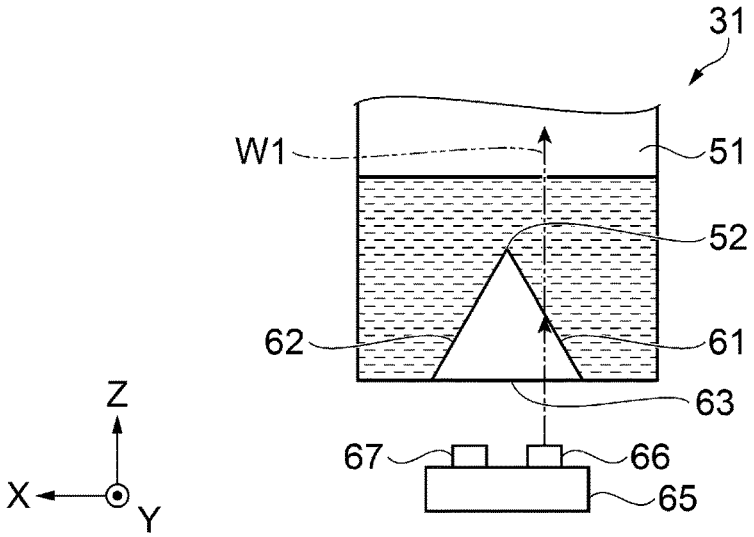
FIG. 9 is a schematic view for explaining liquid detection by a sensor and a prism.
Figure 10:
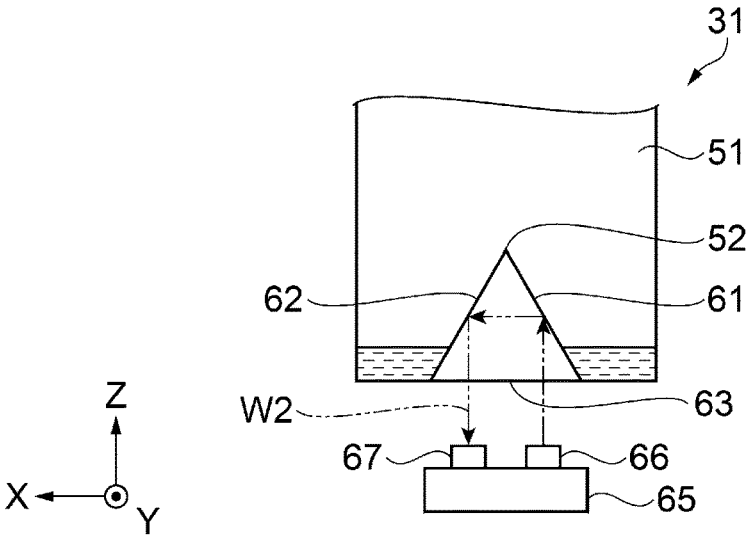
FIG. 10 is a schematic view for explaining liquid detection by the sensor and the prism.
Figure 11:
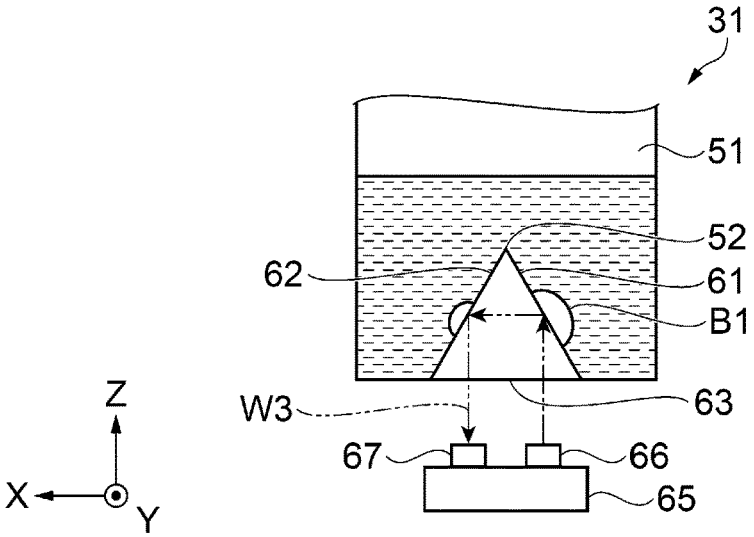
FIG. 11 is a schematic view for explaining liquid detection by the sensor and the prism.

FIGS. 9 to 11 are schematic views for explaining liquid detection by the sensor 65 and the prism 52.

As illustrated in FIGS. 4 and 9 to 11, the sensor 65 includes a light emitting element 66 that emits light to the prism 52 and a light receiving element 67 that receives light reflected by the prism 52. The light emitting element 66 and the light receiving element 67 are arranged side by side along the X axis, and when detecting the liquid in the liquid storage chamber 51, the light emitting element 66 is positioned below the first opening 37 and the light receiving element 67 is positioned below the second opening 38.

When detecting the liquid stored in the liquid storage chamber 51, the light emitting element 66 outputs light toward the prism 52 that passes right above the light emitting element 66. The light output from the light emitting element 66 enters into the prism 52 from the third surface 63 of the prism 52 through the first opening 37. The light entering into the prism 52 advances in the prism 52 and thereby reaches the first surface 61.

As illustrated in FIG. 9, when the first surface 61 and the second surface 62 of the prism 52 contact the liquid, light W1 reaching the first surface 61 is transmitted through the prism 52 and advances in the liquid. This is because a difference between a refractive index of the prism 52 and a refractive index of the liquid is small.

As illustrated in FIG. 10, when the first surface 61 and the second surface 62 of the prism 52 do not contact the liquid, in other words, when the first surface 61 and the second surface 62 contact air, light W2 reaching the first surface 61 is reflected toward the second surface 62. The light W2 reaching the second surface 62 is reflected toward the light receiving element 67. This is because a difference between the refractive index of the prism 52 and a refractive index of the air is large.

When a liquid surface of the liquid stored in the liquid storage chamber 51 is higher than the prism 52, most of the light W1 emitted from the light emitting element 66 is transmitted through the prism 52, and therefore the amount of light received by the light receiving element 67 is small. When the liquid surface of the liquid stored in the liquid storage chamber 51 is lower than the prism 52, most of the light W2 emitted from the light emitting element 66 is reflected by the first surface 61 and the second surface 62 and travels to the light receiving element 67, and therefore the amount of the light received by the light receiving element 67 is large. As a result, based on whether the amount of the light received by the light receiving element 67 is equal to or more than a predetermined threshold or less than the predetermined threshold, it can be detected whether or not a predetermined amount or more of liquid remains in the liquid storage chamber 51.

As described above, the first side surface 41 of the liquid storage chamber 51 is provided with the visual recognition surface 41*a* through which the liquid in the liquid storage chamber 51 is visually recognized through the visual recognition portion 16 and the exposure opening 35. External light also enters the liquid storage chamber 51 from the visual recognition surface 41*a*. When the external light reaches the light receiving element 67 through the prism 52 and the amount of the light received by the light receiving element 67 changes, the liquid in the liquid storage chamber 51 may be erroneously detected. Specifically, when the liquid surface of the liquid is higher than the prism 52 and the first surface 61 and the second surface 62 of the prism 52 contact the liquid, the light receiving amount of the light receiving element 67 becomes less than the predetermined threshold. However, when the light receiving amount of the light receiving element 67 increases due to the external light entering from the visual recognition surface 41*a* and becomes equal to or more than the predetermined threshold, it may be erroneously detected that the liquid is reduced to be less than the predetermined amount even when sufficient liquid remains.

As illustrated in FIGS. 5 and 6, the liquid storage container 31 of the present embodiment includes the wall surface 54 that is closer to the upper surface 44 than the prism 52 and closer to the bottom surface 42 than an end portion 41*b* of the visual recognition surface 41*a* on the upper surface 44 in the first direction. The wall surface 54 protrudes in an eaves shape from the third side surface 45 toward the fourth side surface 46 and covers the prism 52 from above. The wall surface 54 shields at least a part of the external light travelling from the visual recognition surface 41*a* to the prism 52. Thereby, a light amount of the external light reaching the light receiving element 67 is reduced, thus making it possible to suppress erroneous detection of the liquid.

Moreover, the liquid ejecting apparatus 11 of the present embodiment includes the liquid storage container 31 that suppresses erroneous detection of the liquid and is thus able to accurately detect the liquid in the liquid storage container 31.

The liquid storage container 31 of the present embodiment includes the liquid pouring port 53 above the prism 52. In a case where the liquid is poured through the liquid pouring port 53, when liquid in which air is mixed is dropped onto the prism 52 and air bubbles B1 are attached to the prism 52 as illustrated in FIG. 11, the liquid in the liquid storage chamber 51 may be erroneously detected. Specifically, when the liquid surface of the liquid is higher than the prism 52 and the first surface 61 and the second surface 62 of the prism 52 contact the liquid, the light receiving amount of the light receiving element 67 becomes less than the predetermined threshold. However, when the air bubbles B1 are attached to the first surface 61 and the second surface 62 of the prism 52 in a state where the liquid surface of the liquid is higher than the prism 52 after the liquid is poured into the liquid storage chamber 51, parts of the first surface 61 and the second surface 62, to which the air bubbles B1 are attached, contact not the liquid but the air. Thereby, light W3 that is originally to be transmitted through the prism 52 and advance in the liquid is reflected by the first surface 61 and the second surface 62 due to attachment of the air bubbles B1, and therefore the amount of the light received by the light receiving element 67 increases. When the light receiving amount of the light receiving element 67 becomes equal to or more than the predetermined threshold, it may be erroneously detected that the liquid is reduced to be less than the predetermined amount even when sufficient liquid remains.

The wall surface 54 of the present embodiment is provided at a position where the wall surface 54 is overlapped with the liquid pouring port 53 and the prism 52 in plan view in the first direction. The liquid poured through the liquid pouring port 53 is dropped onto the wall surface 54 provided between the prism 52 and the liquid pouring port 53 and is poured into the liquid storage chamber 51 as indicated by black arrows in FIG. 5. In other words, since the liquid mixed with gas is not directly dropped onto the prism 52, the attachment of the air bubbles B1, which are generated when the liquid is poured, to the prism 52 is reduced. This makes it possible to suppress erroneous detection of the liquid.

When the liquid surface of the liquid is higher than the prism 52 and the first surface 61 and the second surface 62 of the prism 52 contact the liquid, the light W1 that is transmitted through the prism 52 and advances in the liquid may be reflected by the wall surface 54, which is provided above the prism 52, and returned to the prism 52. When the amount of the light received by the light receiving element 67 increases and becomes equal to or more than the predetermined threshold, it may be erroneously detected that the liquid is reduced to be less than the predetermined amount even when sufficient liquid remains.

The wall surface 54 of the present embodiment is provided so as to be inclined with respect to the bottom surface 42. Thereby, the light W1 that is transmitted through the prism 52 and advances in the liquid is reflected by the wall surface 54 in a direction different from that of the prism 52, and therefore erroneous detection of the liquid is able to be suppressed.

Moreover, it is desirable that irregularity is formed on a surface of the wall surface 54. As a method of forming the irregularity, emboss processing, surface texturing, dimple processing, or the like is able to be adopted. Thereby, the light W1 that is transmitted through the prism 52 and advances in the liquid is scattered by the wall surface 54, and therefore erroneous detection of the liquid is able to be further suppressed.

The wall surface 54 of the present embodiment extends in a direction from the first side surface 41 toward the second side surface 43 and is inclined from an upper surface 44 side to a bottom surface 42 side. The liquid poured through the liquid pouring port 53 is dropped to a side opposite to a side of the visual recognition surface 41*a*, through which the liquid in the liquid storage chamber 51 is visually recognized, as indicated by the black arrows in FIG. 5. Thereby, attachment of the liquid to the visual recognition surface 41*a* is suppressed, and therefore the amount of the poured liquid is able to be suitably and visually recognized.

Moreover, as indicated by outlined arrows in FIG. 5, air bubbles floating from the filter portion 100 that is provided closer to the second surface 43 than the prism 52 are guided to the first side surface 41 side along the inclination of the wall surface 54, and therefore, the air bubbles that result in gas are able to be suitably discharged from the atmosphere open port 59 provided above the first side surface 41. As a result, gas to be dissolved into the liquid is reduced, and therefore a failure in ejecting of the liquid ejecting head 21, which is caused by gas or bubbles mixed in the liquid, is able to be suppressed.

It is desirable that the wall surface 54 described above includes a light shielding material. As the light shielding material, acrylic resin or urethan resin that contains carbon black or the like serving as an absorbing dye that absorbs light is able to be adopted. As the wall surface 54, a light shielding material is applied to polypropylene resin as a base material. Thereby, the amount of the light that enters from the visual recognition surface 41*a* and is reflected by the wall surface 54 and thereby travels to the prism 52 is able to be effectively reduced by the light shielding material. Note that, the wall surface 54 may be configured to be attached with a light absorbing sheet as the light shielding material. As the light absorbing sheet, for example, "Spectral Black" made by ACKTAR Ltd. or the like is known. Further, the wall surface 54 may be configured to be formed by polypropylene resin that contains carbon black.

The wall surface 54 has a black color by the carbon black contained in the light shielding material. The black color is a color that absorbs light and allows the light, which enters from the visual recognition surface 41*a* and is reflected by the wall surface 54 and thereby travels to the prism 52, to be absorbed by the wall surface 54.

2. Embodiment 2

Figure 12:
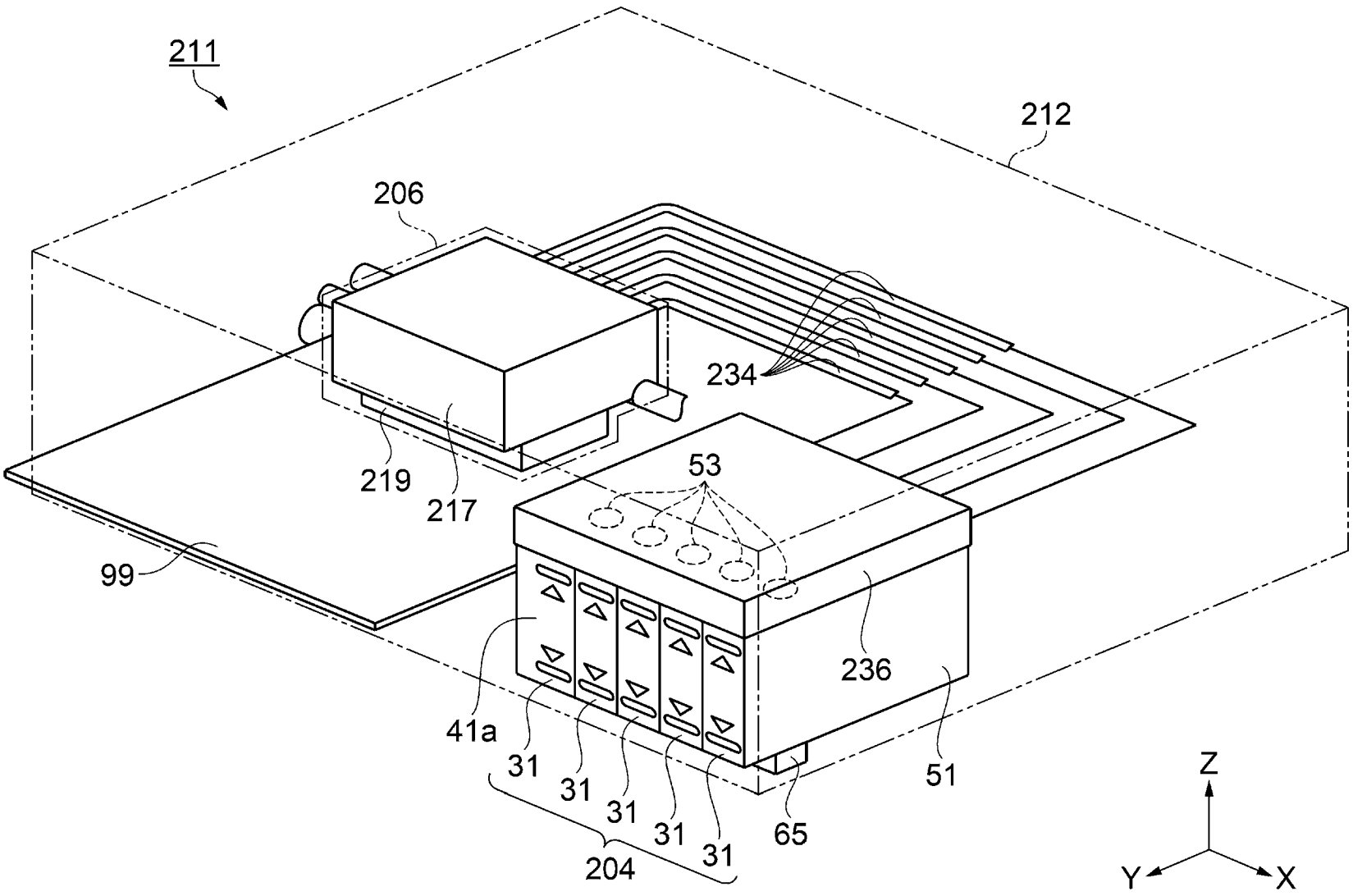
FIG. 12 is a perspective view illustrating a configuration of a liquid ejecting apparatus according to Embodiment 2.

FIG. 12 is a perspective view illustrating a configuration of a liquid ejecting apparatus according to Embodiment 2. A liquid ejecting apparatus 211 includes a recording portion 206 and a liquid supply device 204. The liquid ejecting apparatus 211 has a housing 212, and the recording portion 206 and the liquid supply device 204 are stored in the housing 212.

The recording portion 206 includes a carriage 217 and a liquid ejecting head 219. The recording portion 206 is configured to reciprocate in both directions along the X axis. The liquid ejecting head 219 that ejects liquid onto the medium 99 is mounted on the carriage 217. The liquid ejecting head 219 performs printing by ejecting liquid as liquid droplets onto the medium 99, such as a recording sheet, which is intermittently transported along the Y axis.

The liquid supply device 204 is attached with a plurality of liquid storage containers 31 and supplies the liquid to the liquid ejecting head 219. The liquid supply device 204 of the present embodiment has five liquid storage containers 31.

Each of the liquid storage containers 31 includes the liquid storage chamber 51, the liquid pouring port 53, the coupling portion 55, the filter portion 100, and the like and is constituted by a transparent or semi-transparent material. A configuration of the liquid storage container 31 has been described in Embodiment 1, and therefore description thereof will be omitted.

The visual recognition surface 41*a* provided in the liquid storage container 31 is able to be visually recognized from the outside through an opening provided in the housing 212, in a state where the liquid storage container 31 is attached to the liquid supply device 204. When a cap 236 is opened, the liquid pouring port 53 is exposed and the liquid is able to be poured from the outside into the liquid storage chamber 51.

The liquid ejecting apparatus 211 has a liquid supply tube 234 through which the liquid is supplied from the liquid storage container 31 to the liquid ejecting head 219. When the liquid storage container 31 is attached to the liquid supply device 204, the coupling portion 55 is coupled to one end of the liquid supply tube 234. The other end of the liquid supply tube 234 is coupled to the liquid ejecting head 219. Thereby, the liquid is supplied from the liquid storage container 31 to the liquid ejecting head 219.

The liquid ejecting apparatus 211 includes the sensor 65 that detects, at the bottom surface 42, the liquid stored in the liquid storage chamber 51. A plurality of sensors 65 are provided so as to correspond to the plurality of liquid storage containers 31. Each of the sensors 65 is overlapped with the prism 52 provided in each of the liquid storage chambers 51 in plan view in the first direction. A configuration of the sensor 65 and detection of the liquid have been described in Embodiment 1, and therefore description thereof will be omitted.

The liquid ejecting apparatus 211 of the present embodiment prints an image, a character, or the like on the medium 99 by alternately repeating sub-scanning of causing the medium 99 to be transported along the Y axis and main scanning of causing the liquid ejecting head 219, which is mounted on the carriage 217, to eject liquid while causing the liquid ejecting head 219 to move along the X axis.

Note that, though a configuration in which the liquid supply device 204 is arranged inside the housing 212 has been is explained as an example in the present embodiment, a configuration in which the liquid supply device 204 is arranged outside the housing 212 may be adopted. In this case, the liquid supply device 204 is configured separately from the liquid ejecting apparatus 211.

Moreover, though a configuration in which the liquid storage container 31 is attached to the liquid supply device 204 has been explained as an example in the present embodiment, a configuration in which the liquid storage container 31 is provided so as to be fixed to the liquid supply device 204 may be adopted.

The liquid ejecting apparatus 211 of the present embodiment includes the liquid storage container 31 that suppresses erroneous detection of the liquid described in Embodiment 1 and is thus able to accurately detect the liquid in the liquid storage container 31.

Contents derived from the embodiments will be described below.

A liquid storage container stores liquid to be supplied to a liquid ejecting head that ejects the liquid onto a medium. The liquid storage container includes a liquid storage chamber that includes a bottom surface, an upper surface facing the bottom surface, a first side surface orthogonal to the bottom surface and the upper surface, and a second side surface orthogonal to the bottom surface and the upper surface and facing the first side surface, and that is configured to store the liquid, in which the first side surface is provided with a visual recognition surface configured such that the liquid stored in the liquid storage chamber is visually recognized, the bottom surface is provided with an optical element for detecting the liquid, and the liquid storage chamber is provided with a wall surface closer to the upper surface than the optical element and closer to the bottom surface than an end of the visual recognition surface, which is on a side of the upper surface, in a first direction from the upper surface toward the bottom surface.

According to the aforementioned configuration, in the liquid storage chamber, the wall surface is provided closer to the upper surface than the optical element and closer to the bottom surface than the end of the visual recognition surface, which is on the side of the upper surface. By the wall surface, the amount of external light that enters from the visual recognition surface and reaches the optical element is reduced. Accordingly, it is possible to provide the liquid storage container that suppresses erroneous detection of the liquid.

In the liquid storage container, the upper surface may be provided with a liquid pouring port through which the liquid is poured into the liquid storage chamber, and the wall surface may be overlapped with the liquid pouring port and the optical element in plan view in the first direction.

According to the aforementioned configuration, since the liquid poured through the liquid pouring port is not dropped onto the optical element, attachment of air bubbles, which are generated when the liquid is poured, to the optical element is able to be reduced. Accordingly, it is possible to suppress erroneous detection of the liquid due to the air bubbles attached to the optical element.

In the liquid storage container, the wall surface may be inclined with respect to the bottom surface.

According to the aforementioned configuration, the wall surface is inclined with respect to the bottom surface provided with the optical element. The liquid in the liquid storage chamber is detected based on the amount of light that is emitted to the optical element and the amount of light that is received by the optical element. Since the wall surface is inclined with respect to the bottom surface, it is possible to suppress erroneous detection of the liquid, which is caused when the light that passes through the optical element is reflected by the wall surface and returned to the optical element again.

In the liquid storage container, the wall surface may extend in a direction from the first side surface toward the second side surface and may be inclined from the side of the upper surface to a side of the bottom surface.

According to the aforementioned configuration, since the wall surface extends in the direction from the first side surface toward the second side surface and is inclined from the side of the upper surface to the side of the bottom surface, the liquid poured through the liquid pouring port is dropped to a side opposite to a side of the visual recognition surface through which the liquid in the liquid storage chamber is visually recognized. Accordingly, attachment of the liquid to the visual recognition surface is suppressed, and therefore the amount of the poured liquid is able to be suitably and visually recognized.

In the liquid storage container, the bottom surface may be provided with a filter portion that filters the liquid to be supplied from the liquid storage chamber to the liquid ejecting head, and the filter portion may be positioned closer to the second side surface than the optical element in a second direction from the first side surface to the second side surface.

According to the aforementioned configuration, the liquid filtered by the filter portion provided closer to the second side surface than the optical element is supplied from the liquid storage chamber to the liquid ejecting head. The air bubbles generated when the liquid is poured or when the liquid storage chamber is shaken are guided along the wall surface to the first surface side opposite to the second surface side where the filter is arranged, and are suitably discharged. Thereby, gas to be dissolved into the liquid to be supplied to the liquid ejecting head is reduced, and therefore a failure in ejecting of the liquid ejecting head, which is caused by gas or bubbles mixed in the liquid, is able to be suppressed.

In the liquid storage container, the wall surface may include a light shielding material.

According to the aforementioned configuration, the amount of the light that enters from the visual recognition surface and reaches the optical element through the wall surface is able to be effectively reduced by the light shielding material.

In the liquid storage container, irregularity may be formed on the wall surface.

According to the aforementioned configuration, the amount of the light that enters from the visual recognition surface and reaches the optical element through the wall surface is able to be effectively reduced by the irregularity formed on the wall surface.

In the liquid storage container, the wall surface may have a black color.

According to the aforementioned configuration, the black color absorbs light, and therefore the amount of the light that enters from the visual recognition surface and reaches the optical element through the wall surface is able to be effectively reduced.

A liquid ejecting apparatus includes: the liquid storage container according to any one of liquid storage containers; a carriage on which a liquid ejecting head ejecting liquid onto a medium and the liquid storage container are mounted and which is configured to reciprocate in a third direction that crosses the first direction and is along the second side surface; and a sensor that detects, at the bottom surface, the liquid stored in the liquid storage chamber, in which when the carriage reciprocates in the third direction, the sensor is overlapped with the optical element in plan view in the first direction.

According to the aforementioned configuration, the liquid ejecting apparatus includes the liquid storage container that suppresses erroneous detection of the liquid and the sensor that detects the liquid. Accordingly, it is possible to provide the liquid ejecting apparatus in which accuracy of detecting the liquid in the liquid storage container is improved.

A liquid ejecting apparatus includes: the liquid storage container according to any one of the liquid storage containers; a carriage on which a liquid ejecting head ejecting liquid onto a medium is mounted; a liquid supply tube that supplies the liquid from the liquid storage container to the liquid ejecting head; and a sensor that detects, at the bottom surface, the liquid stored in the liquid storage chamber, in which the sensor is overlapped with the optical element in plan view in the first direction.

According to the aforementioned configuration, the liquid ejecting apparatus includes the liquid storage container that suppresses erroneous detection of the liquid and the sensor that detects the liquid. Accordingly, it is possible to provide the liquid ejecting apparatus in which accuracy of detecting the liquid in the liquid storage container is improved.

What is claimed is:

1. A liquid storage container which stores liquid to be supplied to a liquid ejecting head that ejects the liquid onto a medium, the liquid storage container comprising a liquid storage chamber that includes a bottom surface, an upper surface facing the bottom surface, a first side surface orthogonal to the bottom surface and the upper surface, and a second side surface orthogonal to the bottom surface and the upper surface and facing the first side surface, and that is configured to store the liquid, wherein the first side surface is provided with a visual recognition surface configured such that the liquid stored in the liquid storage chamber is visually recognized, the bottom surface is provided with an optical element for detecting the liquid, and the liquid storage chamber is provided with a wall surface closer to the upper surface than the optical element and closer to the bottom surface than an end of the visual recognition surface, which is on a side of the upper surface, in a first direction from the upper surface toward the bottom surface, the upper surface is provided with a liquid pouring port through which the liquid is poured into the liquid storage chamber, and the wall surface is overlapped with the liquid pouring port and the optical element in plan view in the first direction.

2. The liquid storage container according to claim 1, wherein the wall surface is inclined with respect to the bottom surface.

3. The liquid storage container according to claim 1, wherein the wall surface extends in a direction from the first side surface to the second side surface and is inclined from the side of the upper surface toward a side of the bottom surface.

4. The liquid storage container according to claim 3, wherein the bottom surface is provided with a filter portion that filters the liquid to be supplied from the liquid storage chamber to the liquid ejecting head, and the filter portion is positioned closer to the second side surface than the optical element in a second direction from the first side surface to the second side surface.

5. The liquid storage container according to claim 1, wherein the wall surface includes a light shielding material.

6. The liquid storage container according to claim 1, wherein irregularity is formed on the wall surface.

7. The liquid storage container according to claim 1, wherein the wall surface has a black color.

8. A liquid ejecting apparatus comprising:

the liquid storage container according to claim 1;

a carriage on which a liquid ejecting head ejecting liquid onto a medium and the liquid storage container are mounted and which is configured to reciprocate in a third direction that crosses the first direction and is along the second side surface; and a sensor that detects, at the bottom surface, the liquid stored in the liquid storage chamber, wherein when the carriage reciprocates in the third direction, the sensor is overlapped with the optical element in plan view in the first direction.

9. A liquid ejecting apparatus comprising:

the liquid storage container according to claim 1;

a carriage on which a liquid ejecting head ejecting liquid onto a medium is mounted;

a liquid supply tube that supplies the liquid from the liquid storage container to the liquid ejecting head; and a sensor that detects, at the bottom surface, the liquid stored in the liquid storage chamber, wherein the sensor is overlapped with the optical element in plan view in the first direction.

* * * * *